US008664863B2

(12) United States Patent
Makarov

(10) Patent No.: US 8,664,863 B2
(45) Date of Patent: Mar. 4, 2014

(54) DEVICE AND METHOD OF SUPPLYING POWER TO AN ELECTRON SOURCE, AND ION-BOMBARDMENT-INDUCED SECONDARY-EMISSION ELECTRON SOURCE

(75) Inventor: Maxime Makarov, Gennevilliers (FR)

(73) Assignee: Excico Group, Antwerp (BE)

( * ) Notice: Subject to any disclaimer, the term of this patent is extended or adjusted under 35 U.S.C. 154(b) by 465 days.

(21) Appl. No.: 12/812,245

(22) PCT Filed: Jan. 8, 2009

(86) PCT No.: PCT/FR2009/000017

§ 371 (c)(1),
(2), (4) Date: Nov. 23, 2010

(87) PCT Pub. No.: WO2009/112668

PCT Pub. Date: Sep. 17, 2009

(65) Prior Publication Data

US 2011/0057565 A1 Mar. 10, 2011

(30) Foreign Application Priority Data

Jan. 11, 2008 (EP) ..... 08290026

(51) Int. Cl.
*H01J 7/24* (2006.01)

(52) U.S. Cl.
USPC ..... 315/111.81

(58) Field of Classification Search
USPC ..... 315/111.21, 111.31, 111.41, 111.51, 315/111.61, 111.71, 111.81, 111.91
See application file for complete search history.

(56) References Cited

U.S. PATENT DOCUMENTS

| | | | | |
|---|---|---|---|---|
| 3,970,892 | A | 7/1976 | Wakalopulos | |
| 4,777,370 | A | 10/1988 | Pigache et al. | |
| 4,786,844 | A | 11/1988 | Farrell et al. | |
| 4,955,045 | A * | 9/1990 | Friede et al. | 378/122 |
| 5,055,748 | A * | 10/1991 | Reinhardt | 315/335 |
| 5,057,740 | A * | 10/1991 | Kirkman-Amemiya | 313/542 |
| 5,841,235 | A | 11/1998 | Engelko et al. | |
| 5,910,886 | A * | 6/1999 | Coleman | 363/17 |
| 6,182,604 | B1 * | 2/2001 | Goeckner et al. | 118/723 E |
| 6,500,496 | B1 * | 12/2002 | Goeckner et al. | 427/523 |
| 2006/0121704 | A1 * | 6/2006 | Walther et al. | 438/510 |
| 2007/0188104 | A1 * | 8/2007 | Chistyakov et al. | 315/111.21 |

FOREIGN PATENT DOCUMENTS

| | | | |
|---|---|---|---|
| FR | 2 204 882 | A1 | 5/1974 |
| FR | 2 312 104 | A1 | 12/1976 |
| FR | 2 591 035 | A1 | 6/1987 |
| FR | 2 615 324 | A1 | 11/1988 |
| JP | 5-211052 | A | 8/1993 |
| JP | 8-236053 | A | 9/1996 |
| JP | 10-332897 | A | 12/1998 |

OTHER PUBLICATIONS

International Search Report, dated Sep. 2, 2009, from corresponding PCT application.

* cited by examiner

*Primary Examiner* — Minh D A
(74) *Attorney, Agent, or Firm* — Young & Thompson

(57) ABSTRACT

The power supply device (14) for an ion-bombardment-induced secondary-emission electron source in a low-pressure chamber includes a control input, two high-voltage outputs, an element for generating a plurality of positive pulses on a high-voltage output, and an element for generating a negative pulse on the other high-voltage output after at least some of the positive pulses.

19 Claims, 2 Drawing Sheets

Fig.1
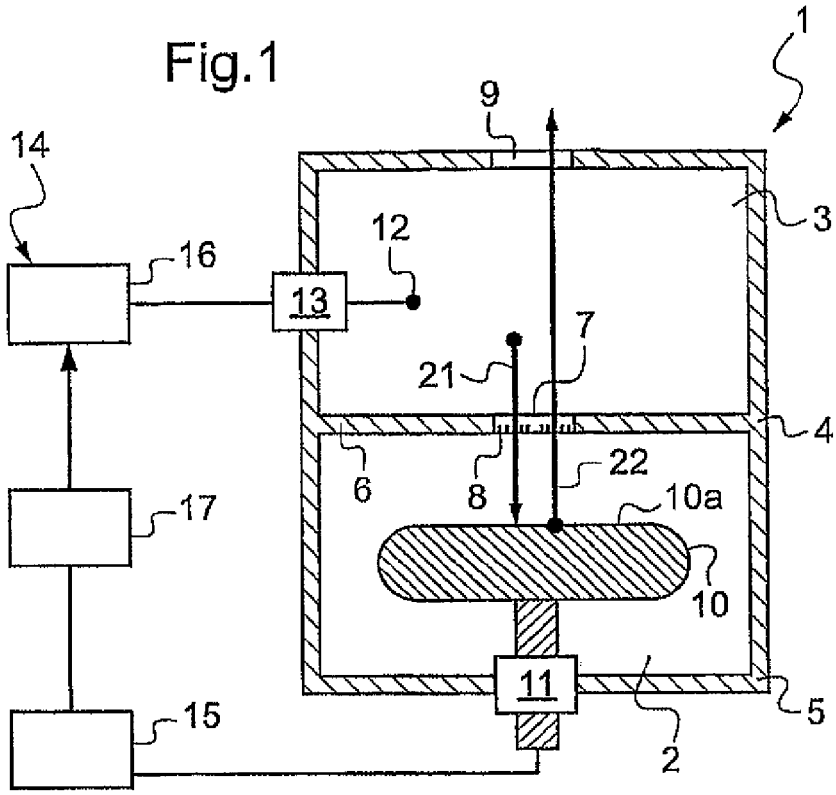
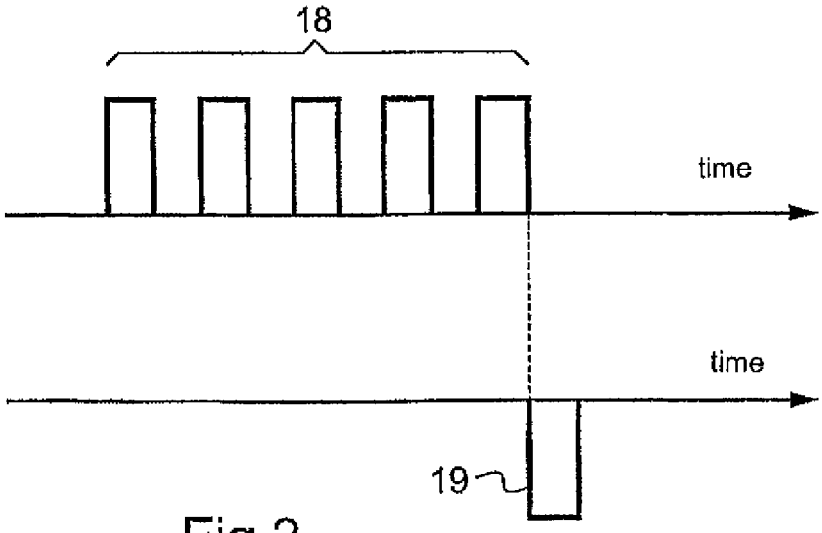
Fig.2

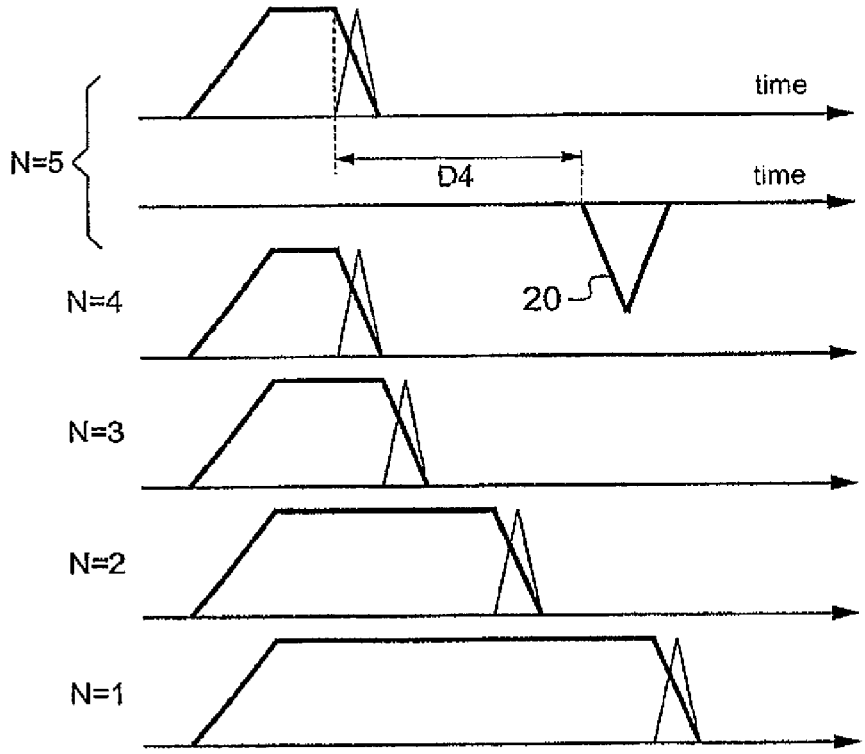
Fig.3
Fig.5
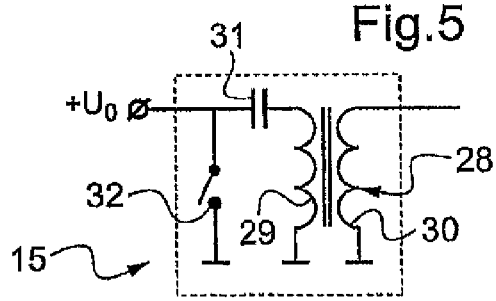
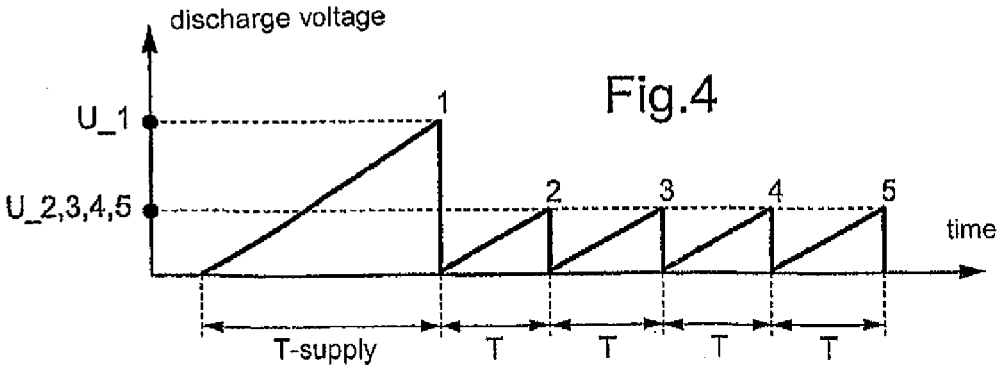
Fig.4

DEVICE AND METHOD OF SUPPLYING POWER TO AN ELECTRON SOURCE, AND ION-BOMBARDMENT-INDUCED SECONDARY-EMISSION ELECTRON SOURCE

BACKGROUND OF THE INVENTION

1. Field of the Invention

The invention relates to the field of pulsed electron sources and devices that make use of such sources, notably gas lasers with electronic excitation or X-ray pulsed pre-ionisation. A pulsed electron source emits an electron beam under the effect of ion bombardment.

2. Description of the Related Art

Reference may be made to the publications FR 2 204 882 or FR 2 591 035. The device comprises an ionisation chamber and an acceleration chamber communicating with the ionisation chamber through a grid. A preliminary discharge takes place in the ionisation chamber. Some of the positive ions thus created are accelerated towards a cathode located in the acceleration chamber. The accelerated ions bombard the cathode and cause the secondary emission of electrons. The accelerated secondary electrons, being repelled by the negative voltage applied to the cathode, then form an electron beam extracted through the grid between the two chambers.

In fact, it tends to become more and more difficult to trigger the discharge in the ionisation chamber as the use of the device continues. The discharge is thus initiated progressively later and there is a danger that it will occur at the same time as the negative voltage impulse applied to the cathode. The simultaneous application of the positive voltage in the ionisation chamber and of the negative voltage in the acceleration chamber risks causing a breakdown or even destruction of the device and the systems for which the device is used. The delayed triggering of the discharge will in any case cause a deterioration in the characteristics of the electron beam obtained as it leaves the source. Natural and hence uncontrolled delaying of the triggering of the discharge in the ionisation chamber is unsatisfactory.

SUMMARY OF THE INVENTION

The present invention sets out to remedy the drawbacks outlined above.

The aim of the invention is in particular to obtain a stable triggering of the electron source which is relatively independent of the operating conditions, such as the ageing of the source.

The electricity supply device for an ion-bombardment-induced secondary-emission electron source in a low pressure chamber comprises a control input, two high voltage outputs, a means for generating a plurality of positive pulses at one high voltage output and a means for generating a negative pulse at the other high voltage output after at least some of the positive pulses. Generating a plurality of positive pulses that can be applied to an electrode of an ionisation chamber makes it easier to trigger the discharge.

In one embodiment, the device comprises means for generating a delay between the end of the operation of the means for generating a plurality of positive pulses and the start of the operation of the means for generating a negative pulse. The delay may be constant or adjustable in order to adapt to the operating parameters, notably the pressure, the molecular mass of the gas, etc.

In one embodiment, the means for generating a plurality of positive pulses is configured so that the first pulse is at a voltage which is higher than that of the following pulses. Even if the first discharge in the ionisation chamber is delayed, the initiation delay stabilises rapidly. The negative pulse can then be controlled after a length of time D1 has elapsed since the command to initiate the last positive pulse, while the length of time D2 between the actuation of the last positive pulse and the triggering of the last discharge in the ionisation chamber may be known precisely. The length of time D3 between the triggering of the last discharge in the ionisation chamber and the actuation of the negative pulse may be determined using the formula D3=D1−D2. Thanks to the invention, the uncertainty as to the length of time D2 is substantially reduced.

The method for supplying electricity to an ion-bombardment-induced secondary-emission electron source in a low pressure chamber comprises a step of generating a plurality of positive pulses at one high voltage output, and a step of generating a negative pulse at another high voltage output after at least some of the positive pulses.

In one embodiment, a delay other than zero separates the end of the last positive pulse of the series of positive pulses from the start of the negative pulse. This ensures the safety of the device.

In one embodiment, the peak voltage of the first positive pulse is greater than the peak voltage of the following positive pulses. The first discharge is made easier by a first high voltage pulse. The discharge can easily be obtained during the following pulses with a lower voltage. The energy consumption is reduced and the ageing of the electricity supply is less.

In one embodiment, the peak voltage of the following positive pulses is substantially equal.

In one embodiment, the duration of the following positive pulses is substantially constant. The reduction in uncertainty as to the length of time D2 makes it possible to increase the precision of the length of time D3.

The voltage of at least one pulse may be increased in the course of ageing.

The electron source comprises a low pressure chamber, an acceleration chamber, a cathode located in the acceleration chamber, an anode located in the low pressure chamber, and an electricity supply device provided with two high voltage outputs, one connected to the anode and the other to the cathode. The electricity supply device comprises means for generating a plurality of positive pulses and means for generating a negative pulse after the positive pulses.

In one embodiment, the source comprises a command module for the means for generating a plurality of positive pulses and for the means for generating a negative pulse. The command module may be configured so as to calculate the delay that will prevent a positive pulse and a negative pulse from occurring simultaneously.

In this way the risks of malfunction, or even failure, of the electron source are considerably reduced. The service life of the electron source is also increased by the reduction in the ageing of the electricity supply and of the ionisation chamber. The cost of using the electron source is thus optimised.

It is also possible to progressively increase the voltage generating the discharge in the course of ageing.

It would also be possible to use an auxiliary source at the cathode, optionally coupled with a system for magnetic confinement of the electrons. However, the service life of the source is then limited because of the vaporisation of the hot anode and the deposit of vaporised materials that forms on the walls of the ionisation chamber, causing a deterioration in the functioning of the source.

BRIEF DESCRIPTION OF THE DRAWING FIGURES

The present invention will be better understood from a study of the detailed description of a number of embodiments taken as non-restrictive examples and illustrated by the attached drawings, wherein:

FIG. 1 is a schematic view of an electron source;

FIG. 2 is a curve showing the evolution of the outputs of the command module;

FIG. 3 is a curve showing the evolution over time of the supply voltage and current;

FIG. 4 is a curve showing the evolution over time of the voltage at the terminals of the electrode of the ionisation chamber; and FIG. 5 is a schematic view of the electricity supply.

DETAILED DESCRIPTION OF THE INVENTION

As can be seen in FIG. 1, the electron source 1 comprises an acceleration chamber 2 and an ionisation chamber 3 defined by an enclosure 4. The ionisation chamber 3 may be elongated in a main direction.

The enclosure 4 comprises an outer casing 5 and an inner wall 6 separating the chambers 2 and 3. The enclosure 4 may be made of metal, for example based on brass or stainless steel. The inner walls defining the acceleration chamber 2 on the one hand and the ionisation chamber 3 on the other hand may be covered with a metal or a metal alloy suitable for the intended use, notably in terms of the electric voltage applied and the gas in the enclosure 4, particularly the nature and pressure of the gas. For example, a coating based on aluminium or nickel may be used to cover the walls of the acceleration chamber 2, and/or the walls of the ionisation chamber 3.

The acceleration chamber 2 and the ionisation chamber 3 are connected via a passage 7 in the form of a through-hole formed in the inner wall 6. The passage 7 may be provided with a grid 8, generally made of metal. An exit 9 is provided in an outer wall of the ionisation chamber 3 opposite the inner wall 6. The exit 9 may be open or fitted with a grid, especially if a gas of a similar nature and at a similar pressure is present in the enclosure 4 and around the enclosure 4. If the conditions of pressure and/or the nature of the gas are different, the exit 9 is generally provided with a seal, not shown, for example in the form of a part made of synthetic material which is impermeable to gas and at least partly permeable to electrons so as to allow the electron flux generated in the source 1 to escape. The seal may also be covered with a layer of metal, notably based on metal with a high atomic mass of, for example, more than 50, with a view to generating X-rays under the effect of the electron bombardment.

The electron source 1 comprises a cathode 10 mounted in the acceleration chamber 2. The cathode 10 may be fixed or rotary. The cathode 10 may be made of a material based on stainless steel or an aluminium alloy. The cathode 10 may take the form of a disc presenting a flat surface 10*a* facing the passage 7 or a cylinder. The passages 7 and 9 and the flat surface 10*a* of the cathode 10 are aligned. The cathode 10 is supported by a gas-tight insulator 11, fixed in a hole formed in an outer wall of the casing 5. The insulator 11 may also be aligned with the openings 7 and 9. The insulator 11 forms an electrical pathway allowing the cathode 10 to be supplied with electricity from outside the casing 5.

The electron source 1 comprises an anode 12 arranged in the ionisation chamber 3. The anode 12 may take the form of one or more wires elongated in the main direction of the chamber 3. The wire may be supplied with power at both ends with a view to increasing the homogeneity of the electrical field.

The anode 12 is supported by a leaktight insulator 13 fixed to a side wall of the outer casing 5, forming a gastight seal and providing the electrical pathway. The anode 12 is offset relative to the alignment of the openings 7 and 9.

The electron source 1 comprises an electricity supply 14 comprising a supply module 15 for the cathode 10, a supply module 16 for the anode 12 and a command module 17. The supply module 15 and the supply module 16 may be of the type shown in FIG. 5. The command module 17 is configured so as to generate pulse control signals which are offset in time between the signal sent to the supply module 16 and the signal sent to the supply module 15. This time offset may be adjusted as a function of the gas pressure in the acceleration chamber 2 and ionisation chamber 3 and the nature of the gas or the gaseous mixture, notably the atomic mass.

In operation, the command module 17 sends a signal 18, see FIG. 2, to the supply module 16. The signal 18 is in the form of a plurality of rectangular signals, notably five such signals. The number of pulses may be increased over time to compensate for the ageing of the source 1. Then, the command module 17 sends a signal 19 to the supply module 15 to apply a high negative voltage to the cathode 10. The signal 19 may be synchronised with the end of the signal 18, optionally with a delay (not shown), or be sent before the end of the signal 18 but after the beginning.

In FIG. 3 the bold lines indicate the waveforms of the voltage while the fine lines show the current supplied by the supply module 16 to the anode 12. The number N denotes the rank of the voltage pulse applied. At the first voltage pulse, the current discharge does not take place until after a high voltage has been applied for a relatively long period. Then this period of a high voltage preceding the discharge decreases from the first to the fourth pulse and remains substantially constant at the fifth pulse. It will be understood that in FIG. 3 the time scales relating to each pulse have been aligned vertically for the purposes of the drawing. Naturally, the pulse of rank N occurs after the pulse of rank N−1. After the last, in this case the fifth, pulse, the command module 17 sends the signal 19 to the supply module 15, causing a high negative voltage to be applied in the form of the curve 20 to the cathode 10. The negative voltage pulse 20 applied to the cathode 10 starts after a length of time D4 has elapsed after the end of the maximum value of the positive voltage pulse on the anode 12, or in other words substantially after the end of the last command pulse of the signal 18 received by the supply module 16. Insofar as the duration of the positive voltage pulse on the anode 12 is substantially constant at the $n^{th}$ pulse, with N=5 in this case, the said duration can be determined by the operating conditions such as the voltage value, the gas pressure, the nature of the gas, the distance between the anode 12 and the walls of the ionisation chamber 3, etc. The duration of the $n^{th}$ positive voltage pulse can be estimated or measured experimentally. The command module 17 can be configured simply and economically to generate the command pulse 19 after a period of time equal to the sum of the length of time D4 and the duration of the positive voltage pulse has elapsed after the end of the command pulse 18.

In one embodiment, shown in FIG. 4, the command module 17 generates a positive voltage command signal comprising a first pulse of a duration greater than the duration of the other pulses of the signal 18, resulting in a longer charge time of the supply module 16 and a higher voltage for the first positive voltage pulse applied to the electrode 12 than that of ranks 2 or more. The Applicant has in fact noticed that the first discharge is particularly difficult to achieve and can be obtained faster and more easily with a higher voltage. The positive voltage pulses of ranks 2 or more can be obtained with a lower voltage, resulting in less stress on the supply module 16 which is subjected to less wear in this case. The optimum voltage can be selected for the first pulse for triggering the first discharge and the optimum voltage for the following pulses can be selected for the stability of the discharges. The voltage of the following pulses may be between 80 and 100% of the voltage of the first pulse. For this purpose a supply module 16 of the pulsed type may be chosen wherein the charging time T-supply is greater than the periodicity of the pulses T. The first discharge is triggered by a higher voltage than the other discharges.

Thanks to the invention, the electron source with multi-pulse triggering supplies a stable electron beam with reduced ageing, while being largely unaffected by the factors of duration and conditions of use. To compensate for the ageing it is also possible to increase over time the voltage of the first pulse, the voltage of the following pulses and/or the number of the following pulses. A regulating knob or automatic regulator may be provided for this purpose. Maintenance is very easy.

During operation, the acceleration chamber 2 and ionisation chamber 3 are filled with a gas, for example helium at a low pressure of between 1 and 20 Pascal, for example. The application of a positive voltage to the anode 12, while the enclosure 4 is connected to earth, causes a voltage pulse discharge. The electrical discharge in the ionisation chamber 3 containing gas causes positive ions to be emitted. Then the voltage pulse at the anode 12 ceases and the negative voltage pulse at the cathode 10 is produced. The positive ions are then attracted by the cathode 10 and travel through the passage 7 to bombard the flat surface 10*a* of the electrode 10 along the trajectory indicated by the arrow 21. The ion bombardment of the cathode 10 causes electrons to be emitted, which are subjected to a repelling effect of the cathode 10 as a result of the high negative voltage applied by the supply module 15. The electrons are accelerated along the trajectory indicated by the arrow 22, travel through the passage 7 then through the exit 9 and thus provide an electron beam.

As shown in FIG. 5, the electricity supply 15 comprises a pulse transformer 28 provided with a primary 29 and a secondary 30. The primary 29 of the pulse transformer 28 is connected to earth on the one hand and to a capacitor 31 on the other hand. On the opposite side from the primary 29, the capacitor 31 is connected to a voltage source $U_0$ and to a switch 32. The switch 32 is also connected to earth so as to be able to short-circuit the capacitor 31 and the primary 29. The secondary 30 is connected to the earth of the power supply on the one hand and to the cathode 10 of the electron source 1 on the other hand.

The electricity supply 15 may also comprise, mounted parallel to the secondary 30, an auxiliary voltage source supplying the bias voltage and connected to the earth of the power supply on the one hand and to the common point between the secondary 30 and the electrode 3, on the other hand. A protective device may be arranged in series with the auxiliary source so as to limit the current circulation. The protective device may comprise at least one diode, a capacitor and/or an inductor. Moreover, a current sensor may be provided at the output from the power supply 15 for measuring the current consumed in the ionisation chamber 2.

During the first phase, the switch 32 forms an open circuit. The capacitor 31 is charged to the voltage $U_0$.

The auxiliary voltage source may maintain the cathode 10 at the positive bias voltage. To limit the losses in the secondary 30, a diode, not shown, may be arranged between the secondary 30 and the point that is common to the protective device and to the cathode 10. After the switch 32 has been closed, short-circuiting the capacitor 31 and the primary 29 of the transformer 28, a high negative voltage pulse $-U_{gun}$ is supplied by the secondary 30 of the transformer 28 and applied to the cathode 10.

The electron source 1 may be modelled electrically by a parasitic capacitance $C_{gun}$. The parasitic capacitance $C_{gun}$ may be reduced considerably on account of the absence or, failing that, the very small amount, of plasma in the acceleration chamber 2 during the first ionisation step. When plasma is present in the acceleration chamber 2, the polarisation of the plasma generates a strong parasitic capacitance. Thanks to the application of the positive bias voltage which prevents positive ions from the plasma from entering the acceleration chamber 2 during the first step, the acceleration chamber 2 is substantially free from plasma at the moment when the high negative voltage $-U_{gun}$ is applied to the cathode 10. The parasitic capacitance $C_{gun}$ therefore remains low. The charging voltage $U_0$ of the power supply 15 may be reduced. Alternatively, the transformation ratio of the transformer 28 may be reduced.

The invention claimed is:

1. An electron source, comprising:

a low pressure chamber;

an acceleration chamber;

a cathode located in the acceleration chamber, an anode located in the low pressure chamber; and a supply device comprising a control input, first and second high voltage outputs, a positive voltage supply module capable of generating two or more positive pulses at the first high voltage output and a negative voltage supply module capable of generating a negative pulse at the second high voltage output after at least two of the positive pulses, said first high voltage output being connected to the anode and the second high voltage output being connected to the cathode.

2. The electron source according to claim 1, further comprising a command module for the positive and negative voltage supply modules.

3. The electron source according to claim 1, wherein the anode comprises a wire supplied with power at both ends, the low pressure chamber being elongated in the direction of the wire.

4. The electron source according to claim 1, further comprising a command module capable of generating a delay between the end of the operation of the positive voltage supply module generating a plurality of positive pulses and the start of the operation of the negative voltage supply module generating a negative pulse.

5. The electron source according to claim 4, wherein the positive voltage supply module is configured so that the first pulse is at a voltage which is higher than that of the following pulses.

6. The electron source according to claim 1, wherein the positive voltage supply module is configured so that the first pulse is at a voltage which is higher than that of the following pulses.

7. A method for supplying electricity to an ion-bombardment-induced secondary-emission electron source in a low pressure chamber, comprising:

generating two or more positive pulses at a first high voltage output connected to an anode; and generating a negative pulse at a second high voltage output connected to a cathode after at least two of the positive pulses.

8. The method according to claim 7, wherein a delay other than zero separates an end of the positive pulse from a start of the negative pulse.

9. The method according to claim 7, wherein a peak voltage of a first positive pulse is greater than a peak voltage of following positive pulses.

10. The method according to claim 9, wherein the peak voltage of the following positive voltage is substantially equal.

11. The method according to claim 10, wherein a delay other than zero separates an end of the positive pulse from a start of the negative pulse.

12. The method according to claim 10, wherein a peak voltage of a first positive pulse is greater than a peak voltage of following positive pulses.

13. The method according to claim 9, wherein a duration of the following positive pulses is substantially constant.

14. The method according to claim 13, wherein a delay other than zero separates an end of the positive pulse from a start of the negative pulse.

15. The method according to claim 13, wherein a peak voltage of a first positive pulse is greater than a peak voltage of following positive pulses.

16. The method according to claim 7, wherein the voltage of at least one pulse is increased in a course of ageing.

17. The method according to claim 16, wherein a peak voltage of a first positive pulse is greater than a peak voltage of following positive pulses.

18. The method according to claim 9, wherein a delay other than zero separates an end of the positive pulse from a start of the negative pulse.

19. An electron source, comprising:

a low pressure chamber;

an acceleration chamber;

a cathode located in the acceleration chamber, an anode located in the low pressure chamber; and a supply device comprising a control input, first and second high voltage outputs, a positive voltage supply module capable of generating at least four positive pulses at the first high voltage output and a negative voltage supply module capable of generating a negative pulse at the second high voltage output after at least two of the positive pulses, a peak voltage of a first positive pulse being greater than a peak voltage of following positive pulses, said first high voltage output being connected to the anode and the second high voltage output being connected to the cathode.

* * * * *

UNITED STATES PATENT AND TRADEMARK OFFICE

CERTIFICATE OF CORRECTION

PATENT NO. : 8,664,863 B2
APPLICATION NO. : 12/812245
DATED : March 4, 2014
INVENTOR(S) : Maxime Makarov It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 709 days.

Signed and Sealed this
Twenty-ninth Day of September, 2015

Michelle K. Lee

Michelle K. Lee
*Director of the United States Patent and Trademark Office*